US005178438A

United States Patent [19]

Beger

[11] Patent Number: 5,178,438

[45] Date of Patent: Jan. 12, 1993

[54] INFANT ROCKING DEVICE

[76] Inventor: Udo Beger, Oberbreitenauer Strasse 27, 8300 Landshut, Fed. Rep. of Germany

[21] Appl. No.: 652,174

[22] Filed: Feb. 7, 1991

[51] Int. Cl.[5] ..... A47C 3/023

[52] U.S. Cl. ..... 297/258; 297/270

[58] Field of Search ..... 297/258, 271, 133, 443, 297/130, 440, 270

[56] References Cited

U.S. PATENT DOCUMENTS

| | | | |
|---|---|---|---|
| 328,000 | 10/1885 | Brown | 297/133 |
| 699,280 | 5/1902 | Barrett | 297/270 X |
| 710,035 | 9/1902 | Bergstrom | 297/258 |
| 1,228,521 | 6/1917 | Bell | 297/133 |
| 1,231,151 | 6/1917 | Gerrard, Jr. | 297/133 |
| 3,026,143 | 3/1962 | Kundtz et al. | 297/258 |
| 3,982,785 | 9/1976 | Ambasz | 297/440 |

*Primary Examiner*—Kenneth J. Dorner
*Assistant Examiner*—J. Bonifanti
*Attorney, Agent, or Firm*—Pitts & Brittian

[57] ABSTRACT

The present invention relates to an infant rocking device comprising a rocking frame (3) and a stretching frame (11) for stretching a sheet adapted to accommodate an infant, the stretching frame (11) being pivotally mounted on the rocking frame (3) by means of at least two detachable couplers (21) of which at least one is respectively arranged at each longitudinal side of the rocking device in the respective area of a free end of the rocking frame (3), and the couplers (21) being formed of positive or interlocking elements adapted to be engaged and disengaged. The rocking device is characterized in that each of the couplers (21) also comprises a clamping sleeve (25) which is adapted to be clamped onto the associated free end (9) of the rocking frame (3) and is thus attachable in a position securing way.

12 Claims, 2 Drawing Sheets

INFANT ROCKING DEVICE

DESCRIPTION

The present invention relates to a baby or infant rocking device in accordance with the preamble of claim 1.

A conventional rocking device may comprise a rocking frame and a stretching frame for stretching a sheet adapted to accommodate an infant. In a simple embodiment, both the rocking frame and the stretching frame are made from a bent tube. A simple rocking frame consists of a steel tube of a correspondingly bent shape. The steel tube comprises two longitudinal sections of bent configuration for permitting a rocking motion, and includes a transverse section for connecting the two longitudinal sections. In the front region of the rocking device, the two free ends of the tube are arcuately bent upwardly and rearwardly in the direction of the lower longitudinal sections.

In accordance with a known rocking device, the stretching frame is divided into a backrest frame and a seat frame which are arranged on the free ends of the rocking frame in a separately pivotable way via couplers. The pivotable coupling connection is so constructed that both the ends of the rocking frame and the free ends of the backrest frame and the seat frame, respectively, have provided therein bores which extend in a direction transverse to the longitudinal direction of the rocking device. Screw bolts are passed through the bores for supporting positive or interlocking elements between the frames.

A nut is provided at the exterior side of the rocking device or rocking frame and rotated for fixing or releasing the positive elements.

The structure of this conventional rocking device is however disadvantageous. To begin with, all frame parts must be provided with accurately dimensioned bores for receiving the respective screw bolts in an axially accurate way.

Furthermore, the assembly of the rocking device is very troublesome. The rocking devices are normally assembled by the dealers. As a rule, several rocking devices are packed into one container at the factory and subsequently sent in a space-saving way to the dealers. The dealers must then assemble the rocking devices prior to sale. The assembly is difficult because the through-bolts must be passed from the inside through the bores of the individual frame parts, and the positive or interlocking members which are part of the couplers must additionally be placed between the rocking frame and the stretching frame.

It is therefore an object of this invention to provide an infant rocking device of the above-mentioned type which can be manufactured in an especially simple way and assembled quickly and easily without any special skills being needed therefor.

This object is attained through the characterizing features of claim 1.

Since each coupler comprises a clamping sleeve which is adapted to be attached onto the associated free end of the rocking frame, a very simple connection is obtained between the rocking frame on the one hand and the stretching frame on the other hand. In particular, there are no troublesome manufacturing operations, as the bores in the rocking frame can be dispensed with.

As becomes apparent, the rocking device can be easily assembled by just sliding the stretching frame over the respective free end of the rocking frame.

This offers the special advantage that the rocking device can be very easily disassembled again. As a result, it can be stowed away or transported in a space-saving way by the final consumer.

In an especially advantageous embodiment, the rocking device of the invention comprises a separate backrest frame and a separate seat frame. This is of special advantage because the rocking device can be easily manufactured and assembled by virtue of the construction of the separate couplers for seat frame and backrest frame on a common clamping sleeve.

This sleeve is advantageously of an integral configuration, whereby uniform handling is made possible.

To secure the position of the stretching frame on the rocking frame in an easy way, the clamping sleeve is slotted in the longitudinal direction. As a result, the circumference thereof can flexibly respond to the respective dimension of the free end of the rocking frame.

In accordance with the present invention, it is also possible to secure the coupling members or the positive members of the coupler in a conventional way by means of a through-bolt, as the latter does not intersect with the free end of the backrest frame. An easily accessible eccentric lever which is connected to a through-bolt via the positive or interlocking members is however provided at the exterior side of the clamping sleeve to allow a simplified securing of the positive members and improved handling. When the lever is pivoted, an eccentric cam surface effects a movement of the one positive member relative to the other one, whereby both are clamped relative to each other.

When the eccentric clamping lever is simply pivoted by about 90°, an engagement or disengagement operation can be carried out in an easy and also very rapid way, which is of course not the case with the screwing or unscrewing of a nut. This is also important for the reason that the adjustment can also take place when an infant is lying in the rocking device.

Since each coupler comprises another clamping sleeve element into which a free frame end of the seat frame and the backrest frame, respectively, can be inserted, this guarantees simple manufacturing and assembling operations as well.

Another advantage regarding simple manufacturing tolerances and a correspondingly easy adaptability of the parts to one another is due to the fact that the clamping sleeve and/or the clamping sleeve elements and/or the eccentric clamping lever are made of a flexible plastic material.

Furthermore, the manufacturing costs can be reduced by the integral construction of one positive element with the clamping sleeve and of the associated other positive element with the clamping sleeve element. The resultant decrease in the number of parts reduces the manufacturing costs and requires less mounting efforts.

Finally, another advantage arising in connection with the simplified manufacture must be seen in the fact that the positive elements, the clamping sleeve and the clamping sleeve elements are injection-molded parts. As a consequence, additional finishing work is hardly required or can even be dispensed with as a rule.

Other details, features and advantages of the present invention will become apparent from the following description with reference to the accompanying drawing, in which.

Figure 1:
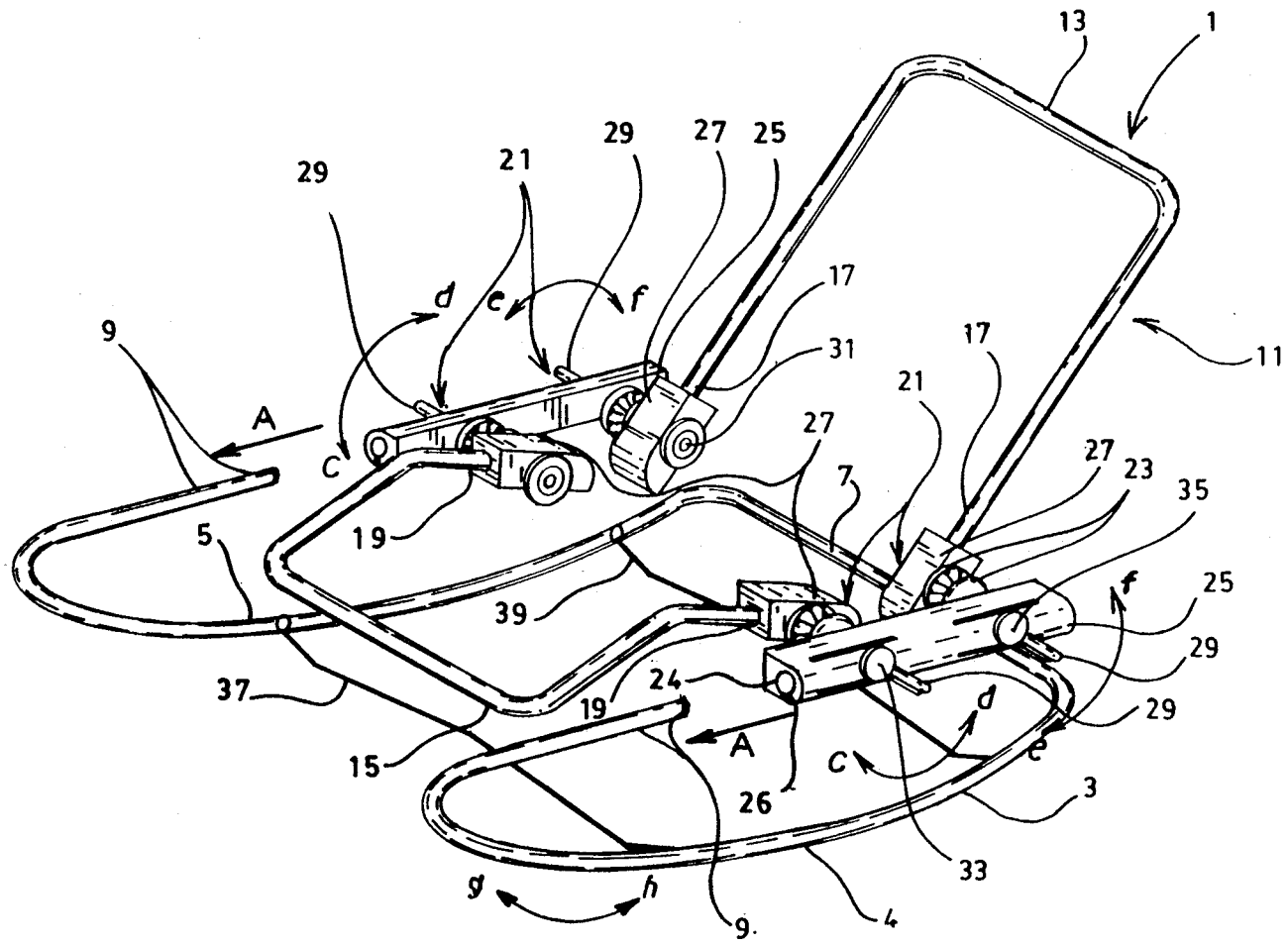
FIG. 1 is a perspective view of a rocking device of the invention, with the rocking frame and the stretching frame being not assembled yet.

FIG. 1 illustrates an infant rocking device 1 of the invention. The rocking device 1 comprises a rocking frame 3 which may e.g. be of a conventional type. In the illustrated embodiment, the rocking frame 3 consists of a bent tube comprising lateral longitudinal sections 4 and 5 and a rear transverse section 7 which is integral with the lateral longitudinal sections 4 and 5. At the front end of the rocking device 1 the free ends 9 of the rocking frame 3 are bent upwards and subsequently rearwards, so that they extend substantially above the lateral longitudinal sections 4 and 5. In the region of its lateral longitudinal sections 4 and 5, the rocking frame 3 has a bent shape which allows a rocking movement.

The rocking device 1 of the invention also comprises a stretching frame 11 which serves to stretch the sheet (not shown) on which the infant is placed. The stretching frame 11 is divided into two partial frames, namely a backrest frame 13 and a seat frame 15. In a simple embodiment as the illustrated one, the backrest frame 13 also consists of a bent tube having a U-shaped configuration. Hence, the "U" also comprises free ends 17.

By analogy, the seat frame 15 is formed from a bent tube which is also of a U-shaped configuration, with bends being additionally provided in the two legs of the "U". Hence, the seat frame 15 also comprises free ends 19.

Couplers 21 are provided for hingedly mounting both the seat frame 15 and the backrest frame 13 on the rocking frame 3. The couplers 21 comprise positive or interlocking elements 23 which are formed as toothed discs or toothed disc elements, e.g., plate means in the illustrated embodiment. One of the positive or interlocking elements 23 is connected to a clamping sleeve 25, having a bore 24 whereas the other positive element 23 of the coupler 21 is connected to a clamping sleeve element 27. At its end associated with the respective frame, the clamping sleeve element 23 comprises a bore into which the backrest frame 13 and the seat frame 15, respectively, are clamped.

In the illustrated embodiment, the couplers 21 are out of engagement because the positive or interlocking elements 23 are disengaged. This allows the free adjustment of the two frames 13 and 15.

An lever clamping lever 29 which is connected to a through-bolt 31 by means of a journal 33 is provided for bringing the positive or interlocking elements 23 into engagement. The lever clamping lever 29 comprises an eccentric cam 35 which comes into contact with the clamping sleeve 25.

The positive or interlocking elements are clamped or engaged by rotating the lever out of the opened positions d and e into the closing position c and f, respectively, by about 90° around the journal 33, with the eccentric cam 35 sliding along the clamping sleeve 25. The rotational axis of the journal 33 moves outwards on account of the eccentric, whereby the through-bolt 31 also moves outwards. This bolt carries along the associated positive element 23. The eccentric cam 35 is so dimensioned that after the lever 29 has been shifted, the positive elements 23 are securely engaged, whereby the respective positions of frame 13 and frame 15 are secured.

Figure 2:
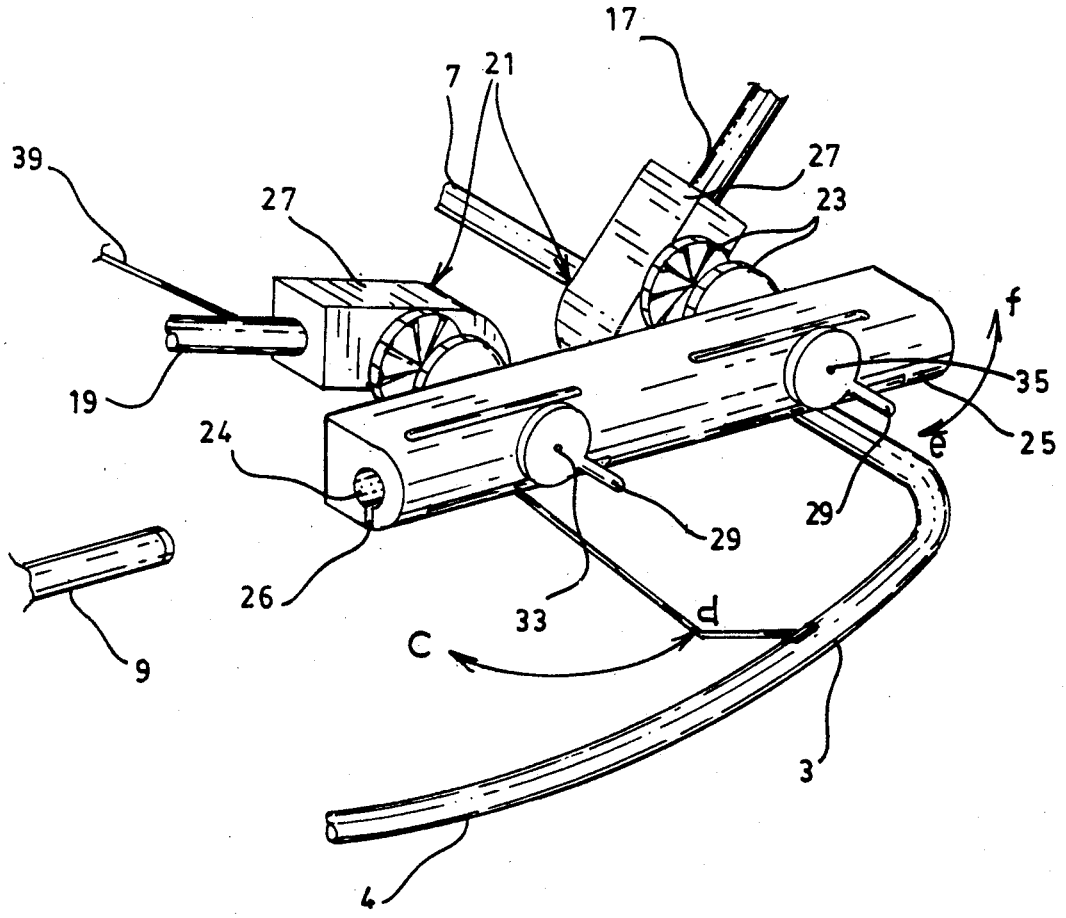
FIG. 2 is an enlarged drawing illustrating the coupler portions which join the rocking frame and the stretching frame illustrated in FIG. 1.

The stretching frame 11 formed in this way is now connected to the rocking frame 3 by sliding the two clamping sleeves 25 in the direction of arrow A onto the free ends 9 of the rocking frame 3. For achieving a satisfactory clamping action on the one hand and for reducing the demand on the manufacturing tolerance on the other hand, the lower region of the clamping sleeve 25 comprises a slot 26 extending in the longitudinal direction (see FIG. 2). Furthermore, at the rear end, i.e. at the end of the clamping sleeve 25 which is opposite the free end 9 of the rocking frame 3, the clamping sleeve includes a stop (not shown). Hence, the clamping sleeve 25 is attached to the rocking frame 3 up to the stop over the free end 9 of the rocking frame 3.

Furthermore, there are rocking-motion stopping devices 37 and 39 which are e.g. constructed as bent rods. The rocking frame 3 can be arrested on the floor, and a rocking motion can be prevented by pivoting the stopping device from position h into position g.

Hence, this invention provides an infant rocking device which is easy to manufacture and assemble and allows an especially easy handling of the adjusting mechanism for pivoting the frames 13 and 15 individually and separately.

Of course, the stretching frame 11 may also consist of a single frame part which is mounted with a respective coupler 21 on the clamping sleeve 25, whereby the stretching frame can be pivoted as a whole.

I claim:

1. An infant rocking device characterized by easy assembly and disassembly, said rocking device comprising:

a rocking frame portion (3), said rocking frame portion having a pair of rocker elements (4, 5) each defining a rearward portion and a forward portion, each said forward portion being bent to be directed toward said rearward portion to define a rearward facing free end (9);

a stretching frame portion (11) for receiving a sheet adapted to support an in fact, said stretching frame portion having a backrest frame portion (13) for receiving one end of said sheet and a seat frame portion (15) for receiving an opposite end of said sheet, each said backrest frame portion and said seat frame portion having a free end (17 and 19, respectively) at each side of said rocking device; and a coupler means (21) at each side of said rocking device, each said coupler means releasably engaging one of said free ends of said rocking frame portion and releasably engaging said stretching frame portion, said coupler means further providing for pivotal movement of said stretching frame portion with respect to said rocking frame portion, each said coupler means comprising a) a coupling sleeve portion (25) having a bore (24) to receive said free end of said rocking frame portion, b) a first coupling element (27) releasably secured to said free end of said backrest frame portion of said stretching frame portion, c) a second coupling element (27) releasably secured to said free end of said seat frame portion of said stretching frame portion, d) a first adjustment interlocking means joining said first coupling element to said coupling sleeve portion for providing selective pivotal motion between said backrest frame portion with respect to said coupling sleeve portion, said first adjustment interlocking means having a first plate means (23) with a toothed surface attached to said first coupling element, a second plate means (23) with a complementary toothed surface attached to said coupling sleeve portion, and a clamping means for bringing said toothed surface of said first plate means into engagement with said toothed surface of said second plate means, and e) a second adjustment interlocking means joining said second coupling element to said coupling sleeve portion for selective pivotal motion between said seat frame portion with respect to said coupling sleeve portion, said second adjustment interlocking means having a third plate means with a toothed surface attached to said second coupling element, a fourth plate means with a complementary toothed surface attached to said coupling sleeve portion, and a second clamping means for bringing said toothed surface of said third plate means into engagement with said toothed surface of said fourth plate means.

2. The rocking device of claim 1 wherein each of said first and second clamping means comprises:

a through-bolt (31) passing through said pair of plate means of each of said adjustment interlocking means and through said clamping sleeve portion; and a clamping lever means (29), attached to said through-bolt, having an eccentric cam (35) to contact said clamping sleeve portion for releasably engaging said pair of plate means whereby movement of said clamping lever means in one direction unlocks said pair of plate means to permit pivotal movement relative to each other, and movement of said clamping lever means in a second direction locks said pair of plate means to prevent pivotal movement relative to each other.

3. The rocking device of claim 1 wherein said clamping sleeve portion is provided with a longitudinal slot (26) to facilitate releasably receiving said free end of said rocking frame portion into said bore.

4. The rocking device of claim 1 wherein said coupler means are made of a flexible plastic material.

5. The rocking device of claim 1 wherein said second plate means and said fourth plate means are integral with said coupling sleeve portion.

6. The rocking device of claim 1 further comprising:

a first rocking motion stopping device (37) attached to said rocking frame portion proximate said forward portion of said rocker elements; and a second rocking motion stopping device (39) attached to said rocking frame portion proximate said rearward portion of said rocker elements.

7. An infant rocking device characterized by easy assembly and disassembly, said rocking device comprising:

a rocking frame portion (3), having a pair of rocker elements (4, 5) each defining a rearward portion and a forward portion, said rocker elements formed from a continuous tubular member including a rearward transverse element, each said forward portion being bent to be directed toward said rearward portion to define a rearward facing free end (9);

a stretching frame portion (11) for receiving a sheet adapted to support an in fact, said stretching frame portion having a U-shaped backrest frame portion (13) for receiving one end of said sheet and a U-shaped seat frame portion (15) for receiving an opposite end of said sheet, each said backrest frame portion and said seat frame portion having a free end (17 and 19, respectively) at each side of said rocking device; and a coupler means (21) at each side of said rocking device, each said coupler means releasably engaging said free ends of said rocking frame portion and releasably engaging said stretching frame portion, each said coupler means comprising a) a coupling sleeve portion (25) having a bore (24) to receive one of said free ends of said rocking frame portion, b) a first coupling element (27) releasably secured to said free end of said backrest frame portion of said stretching frame portion, c) a second coupling element (27) releasably secured to said free end of said seat frame portion of said stretching frame portion, d) a first adjustment interlocking means joining said first coupling element to said coupling sleeve providing for selective pivotal motion between said backrest frame portion with respect to said coupling sleeve portion, said first adjustment interlocking means having a first plate means with a toothed surface attached to said first coupling element, a second plate means (23) with a complementary toothed surface attached to said coupling sleeve portion, and a clamping means for bringing said toothed surface of said first plate means into engagement with said toothed surface of said second plate means; and e) a second adjustment interlocking means joining said second coupling element to said coupling sleeve portion for providing selective pivotal motion between said seat frame portion and said coupling sleeve portion, said second adjustment interlocking means having a third plate means with a toothed surface attached to said second coupling element, a fourth plate means having a complementary toothed surface attached to said coupling sleeve portion, and a second clamping means for bringing said toothed surface of said third plate means into engagement with said toothed surface of said fourth plate means;

whereby said seat frame portion and said backrest frame portion are pivotal with respect to each other and to said rocking frame portion thereby providing for pivotal movement of said stretching frame portion with respect to said rocking frame portion.

8. The rocking device of claim 7 wherein each of said first and second clamping means comprises:

a through-bolt (31) passing through said pair of plate means of each of said adjustment interlocking means and through said clamping sleeve portion; and a clamping lever means (29), attached to said through-bolt, having an eccentric cam (35) to contact said clamping sleeve portion for releasably engaging said pair of plate means whereby movement of said clamping lever means in one direction unlocks said pair of plate means to permit pivotal movement relative to each other, and movement of said clamping lever means in a second direction locks said pair of plate means to prevent pivotal movement relative to each other.

9. The rocking device of claim 7 wherein said clamping sleeve portion is provided with a longitudinal slot (26) to facilitate releasably receiving said free end of said rocking frame portion into said bore.

10. The rocking device of claim 7 wherein said coupler means are made of a flexible plastic material.

11. The rocking device of claim 7 wherein said second plate means and said fourth plate means are integral with said coupling sleeve portion.

12. The rocking device of claim 7 further comprising:

a first rocking motion stopping device (37) attached to said rocking frame portion proximate said forward portion of said rocker elements; and a second rocking motion stopping device (39) attached to said rocking frame portion proximate said rearward portion of said rocker elements.

* * * * *